US006484683B2

(12) United States Patent
Zielke

(10) Patent No.: US 6,484,683 B2
(45) Date of Patent: Nov. 26, 2002

(54) ROCKER CARRIER

(75) Inventor: Martin R. Zielke, Lockport, IL (US)

(73) Assignee: International Engine Intellectual Property Company, L.L.C., Warrenville, IL (US)

( * ) Notice: Subject to any disclaimer, the term of this patent is extended or adjusted under 35 U.S.C. 154(b) by 0 days.

(21) Appl. No.: 09/768,520

(22) Filed: Jan. 24, 2001

(65) Prior Publication Data

US 2002/0117141 A1 Aug. 29, 2002

Related U.S. Application Data

(60) Provisional application No. 60/178,161, filed on Jan. 26, 2000.

(51) Int. Cl.[7] ..... F01L 1/18
(52) U.S. Cl. ..... 123/193.5; 123/90.39
(58) Field of Search ..... 123/193.3, 193.5, 123/90.41, 90.39, 90.27

(56) References Cited

U.S. PATENT DOCUMENTS

| | | | | | |
|---|---|---|---|---|---|
| 4,214,560 | A | | 7/1980 | Nikly | |
| 4,502,427 | A | * | 3/1985 | Brille | 123/90.41 |
| 4,505,236 | A | | 3/1985 | Nakamura | |
| 4,658,770 | A | | 4/1987 | Okuyama et al. | |
| 5,005,544 | A | | 4/1991 | Spangler | |
| 5,095,860 | A | | 3/1992 | Newell | |
| 5,095,861 | A | | 3/1992 | Dove, Jr. | |
| 5,123,385 | A | * | 6/1992 | Sado et al. | 123/193.5 |
| 5,339,778 | A | | 8/1994 | Reckzugel et al. | |
| 5,564,374 | A | | 10/1996 | Hoffman et al. | |
| 5,596,958 | A | | 1/1997 | Miller | |
| 5,617,818 | A | | 4/1997 | Luders | |
| 5,636,600 | A | * | 6/1997 | Sweetland et al. | 123/90.41 |
| 5,645,025 | A | | 7/1997 | Caya et al. | |
| 5,651,337 | A | * | 7/1997 | Regueiro | 123/193.3 |
| 5,669,344 | A | * | 9/1997 | Regueiro | 123/90.27 |
| 5,682,849 | A | * | 11/1997 | Regueiro | 123/90.27 |
| 5,884,594 | A | | 3/1999 | Wiehle | |
| 6,041,750 | A | | 3/2000 | Miller | |
| 6,178,936 | B1 | * | 1/2001 | Kouchi et al. | 123/90.41 |
| 6,178,937 | B1 | * | 1/2001 | Solomon et al. | 123/90.41 |
| 6,408,808 | B1 | * | 6/2002 | Yi | 123/90.27 |

* cited by examiner

*Primary Examiner*—Marguerite McMahon
(74) *Attorney, Agent, or Firm*—Dennis Kelly Sullivan; Jeffrey P. Calfa; Neil T. Powell

(57) ABSTRACT

There is provided a rocker carrier for use with a cylinder head in an internal combustion engine comprising a body portion having a continuous peripheral wall including a front and rear wall connected between a first and second end wall, a plurality of rocker arm pedestals comprised of a dual or end rocker arm pedestals integrally formed on the body portion and disposed between the rear and front walls, a top surface, and a bottom surface. The rocker carrier further comprises a plurality of support fins, a high pressure oil line passage, a plurality of high pressure oil reservoir bosses, a plurality of exterior head bolt passages, a plurality of carrier bolt bosses, a plurality of glow plug passages, a plurality of electrical connector passages, and an oil drain passage, and a plurality of valve cover bolt bosses formed adjacent to the rear wall.

26 Claims, 9 Drawing Sheets

SECTION B-B

SECTION A-A

SECTION D-D

SECTION E-E

SECTION C-C

OIL RAIL INSTALLED

ROCKER CARRIER

This patent application claims the benefit of Provisional U.S. patent application Serial No. 60/178,161 filed on Jan. 26, 2000.

FIELD OF THE INVENTION

This invention relates generally to cylinder heads in internal combustion engines. More particularly, this invention relates to cylinder heads having carriers for a rocker arm assembly in a diesel engine.

BACKGROUND OF THE INVENTION

Internal combustion engines have intake and exhaust valves for air to enter and exhaust to leave each cylinder. The valves connect to rocker arms, which rotate on a pivot ball to open and close the valves. Typically, there is a separate rocker arm for each valve. Push rods operate the rocker arms and extend through the engine cylinder head to connect to a camshaft, via tappets. As the camshaft rotates, the push rods actuate the rocker arms to open and close the valves. The camshaft is designed to open and close the valves in conjunction with the cycling of the piston in the cylinder.

In the prior art, a pedestal is required as an upper support for the pivot ball on the rocker arm. The pedestal is bolted to the cylinder head to complete the assembly. This design requires significant bosses in the head and a substantial pedestal to support the valve train loads. The bosses and pedestals add weight to the engine. In addition, the rocker arms and related components are assembled along with the rest of the engine. This increases the assembly time of the engine.

Accordingly, there is a need for a rocker carrier with sufficient structural support to reduce engine weight and a modular design to reduce assembly time of the engine.

SUMMARY OF THE INVENTION

The present invention provides a rocker carrier with a modular design that adapted for use with a cylinder head in an internal combustion engine. The rocker carrier comprises a body portion having a continuous peripheral wall including a front and rear wall connected between a first and second end wall, a plurality of rocker arm pedestals integrally formed on the body portion and disposed between the rear and front walls, a top surface able to cooperatively engage a valve cover, and a bottom surface able to cooperatively engage a cylinder head. The rocker arm pedestals of the rocker carrier are further made up of dual rocker arm pedestals and/or an end rocker pedestals.

The rocker carrier of the present invention can also comprise a plurality of support fins, a high pressure oil line passage integrally formed adjacent to the rear wall, a plurality of high pressure oil reservoir bosses integrally formed on the body portion and disposed between the rocker arm pedestals and the front wall, a plurality of exterior head bolt passages, a plurality of carrier bolt bosses, a plurality of glow plug passages, a plurality of electrical connector passages, and an oil drain passage, and a plurality of valve cover bolt bosses formed adjacent to the rear wall.

The rocker carrier is preferably connected to the cylinder head. A valve cover secures to the top of the rocker carrier thus enclosing the cylinder head. One of the functions of the rocker carrier is to mount the rocker arm assemblies containing the rocker arms and related parts. The rocker arm carrier also mounts a high pressure oil rail that provides high pressure oil to thereby actuate fuel injectors. In addition, it provides a place to pass electrical wires from the engine harness to the fuel injector and glow plug under the valve cover.

The rocker carrier of the present invention reduces the bosses, pedestals, and other structural support components used for a rocker arm assembly which results in weight savings. In addition to the weight savings, the modular design permits pre-assembly of the rocker carrier thereby reducing the assembly time of the engine in the assembly plant. The rocker carrier also has funnel shaped guides in a bottom or underside surface of the rocker carrier for aligning the push rods. The rocker carrier will also allow for increased bolt stretch to produce an acceptable cylinder head to crank shaft joint.

The following drawings and description set forth additional advantages and benefits of the invention. More advantages and benefits are obvious from the description and may be learned by practice of the invention.

BRIEF DESCRIPTION OF THE DRAWINGS

The present invention may be better understood when read in connection with the accompanying drawings, of which.

DESCRIPTION OF THE INVENTION

Figure 1:
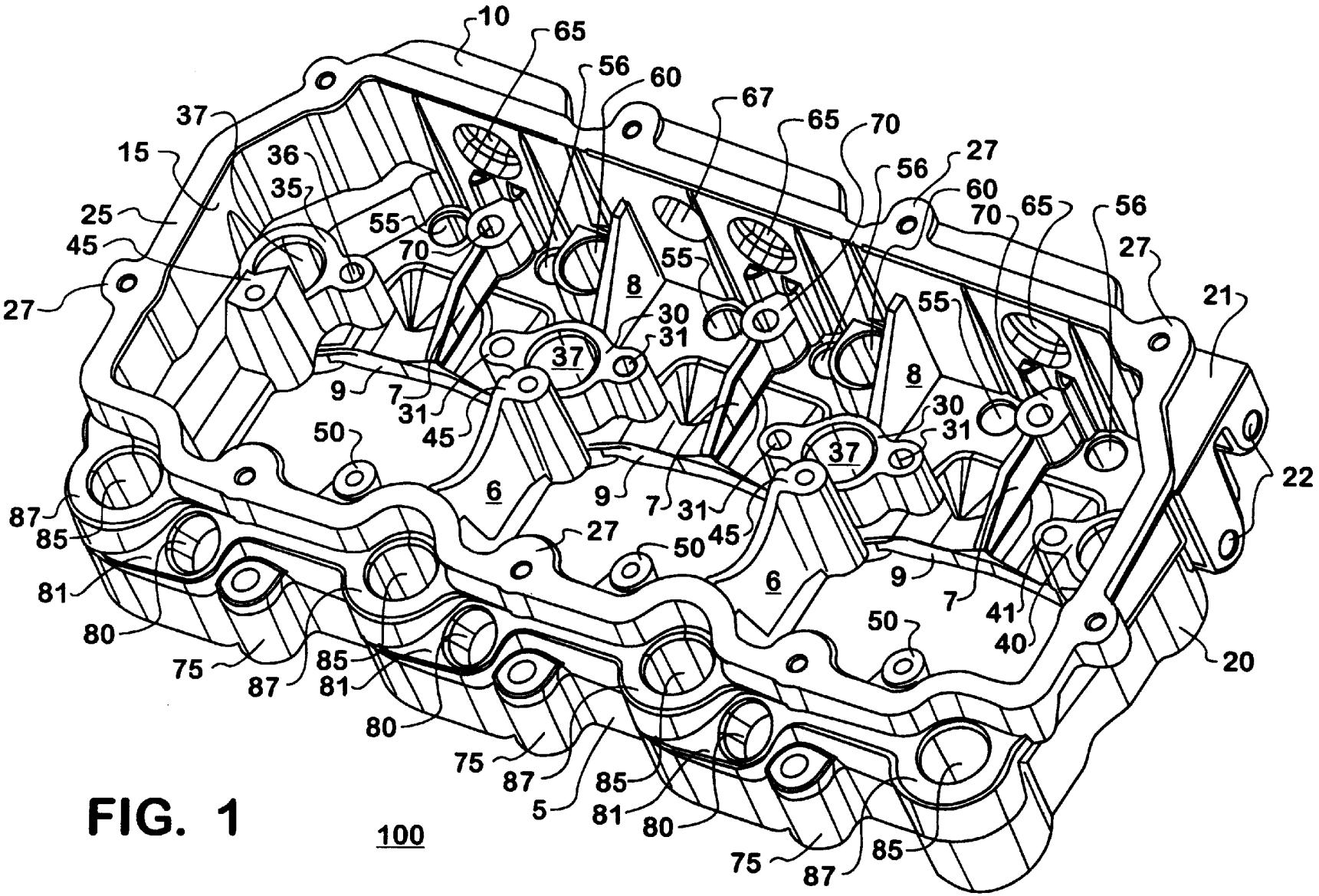
FIG. 1 shows a perspective view of an embodiment of a rocker carrier according to the present invention.
Figure 2:
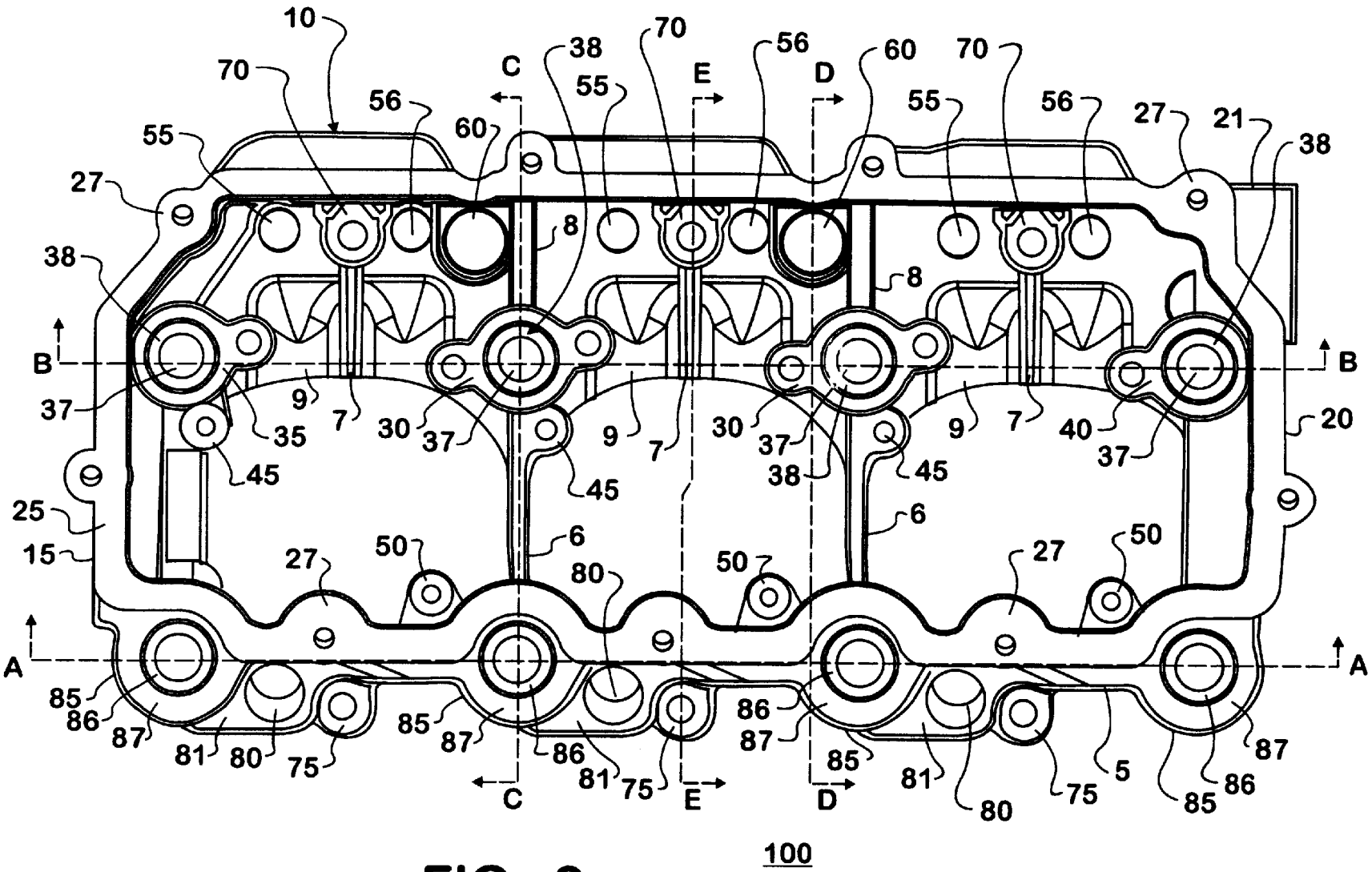
FIG. 2 shows a top view of the embodiment of the rocker carrier shown in FIG. 1.
Figure 11:
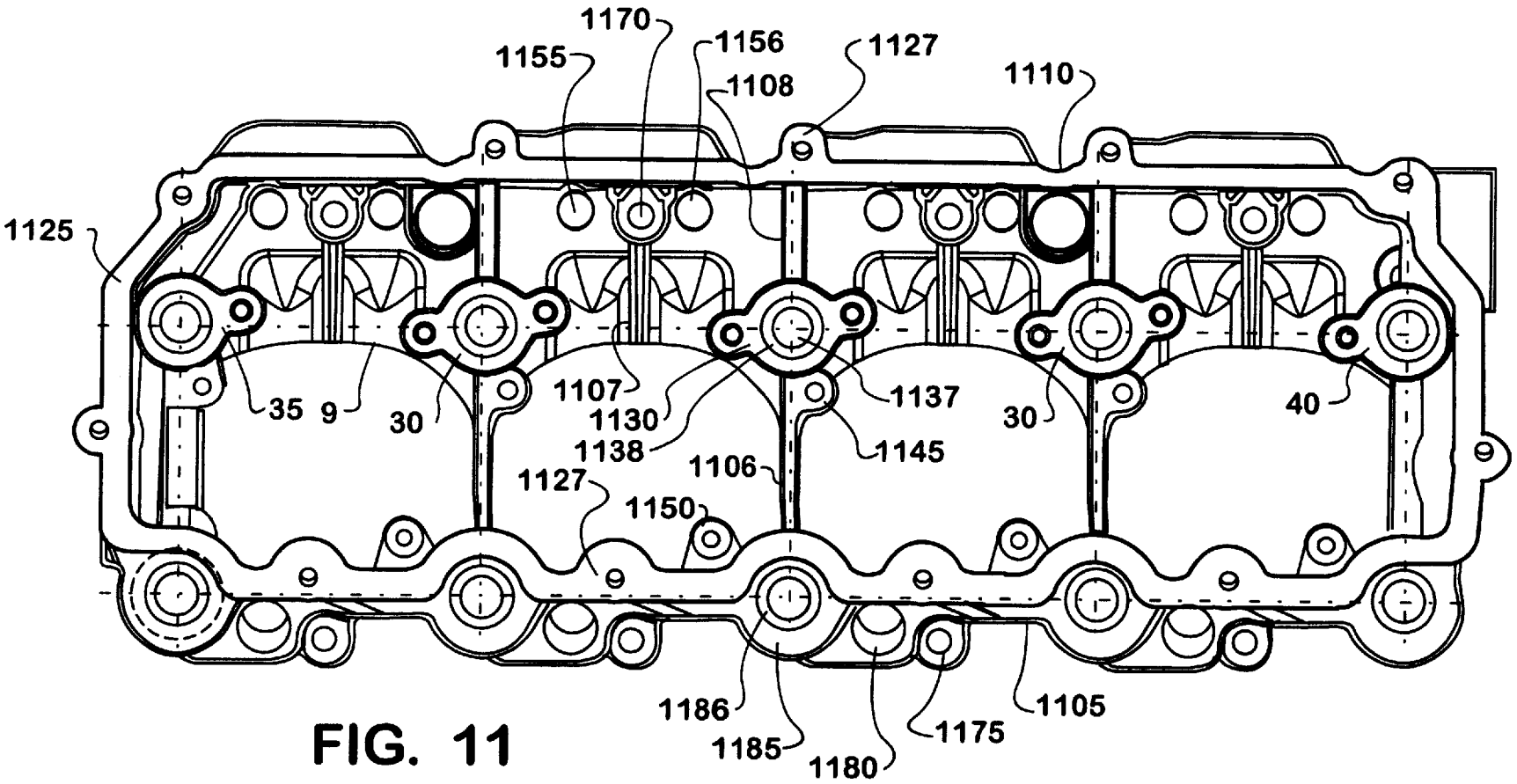
FIG. 11 shows a top view of a second embodiment of the rocker carrier according to the present invention.

FIGS. 1 and 2 show a perspective and a top view of a first embodiment of a rocker carrier 100 according to the present invention. The rocker carrier 100 is preferably adapted for mounting on top of a cylinder head (shown in FIG. 13) in an internal combustion engine comprising, e.g., a gasoline or diesel engine. The embodiment depicted in FIGS. 1 and 2 is preferably mounted on the cylinder head of a six-cylinder engine with V-type configuration. Those of skill in the art will readily recognize that the rocker carrier 100 can be easily modified to cooperatively mount on an eight cylinder V-type engine (as shown in FIG. 11). Moreover, the rocker carrier 100 of this embodiment can be interchangeably mounted on either cylinder head bank or side of an engine.

FIGS. 1 and 2 shows a rocker carrier body portion 100 that has a relatively thin and continuous peripheral wall that is made up of a front 5 and rear 10 wall connected between first 15 and second 20 opposing peripheral end walls. There is further a bottom support floor 9 that spans to connect the rear wall 10 and the back portions of the first 15 and second 20 opposing peripheral end walls. The bottom support floor 9 can serve to give the rocker carrier 100 added structural strength and as a foundation for other portions of the rocker carrier 100. The rocker carrier 100 is preferably integrally cast as single piece of aluminum material, though other suitable materials may be used instead. The unfinished rocker carrier 100 is then machined or finished as required for a particular engine application.

The rocker carrier body 100 is preferably integrally cast with a plurality of rocker arm pedestals 30, 35 and 40 disposed between the front 5 and rear 10 rocker carrier walls. The rocker arm pedestals 30, 35, and 40 will be used to mount rocker arm assemblies 1205, 1210, and 1215 (shown in FIG. 12) which are used to actuate valve bridges (not shown). The location of the rocker arm pedestals 30, 35 and 49 is important because they locate and position the rocker arm assemblies 1205, 1210 and 1215. Correct location of the rocker arm pedestals 30, 35 and 40 will lead to equally distributed loads on the valve bridges (not shown) which actuate the valves. Uneven loading of the valve bridges can result in uneven loading of the valves and edge loading of the stems which leads to premature wear and reduced life of valve stems.

The rocker arm pedestals 35, 40, and 45 preferably have two configurations, though more or less configuration may be used. There is dual rocker arm pedestal 30 (of which two are shown in the rocker carrier of FIGS. 1 and 2) which will cooperatively support a dual fulcrum plate 1212 (shown in FIG. 12) of a dual rocker arm assembly 1210. There are also shown single or end rocker arm pedestals 35 and 40 in the rocker carrier 100 which are adjacent to the first 12 and second 20 end walls. The single or end rocker carrier pedestals will preferably support a single or end fulcrum plate 1203 and 1217 (shown in FIG. 12) of respective single or end rocker arm assemblies 1205 and 1215 (shown in FIG. 12).

Figure 12:
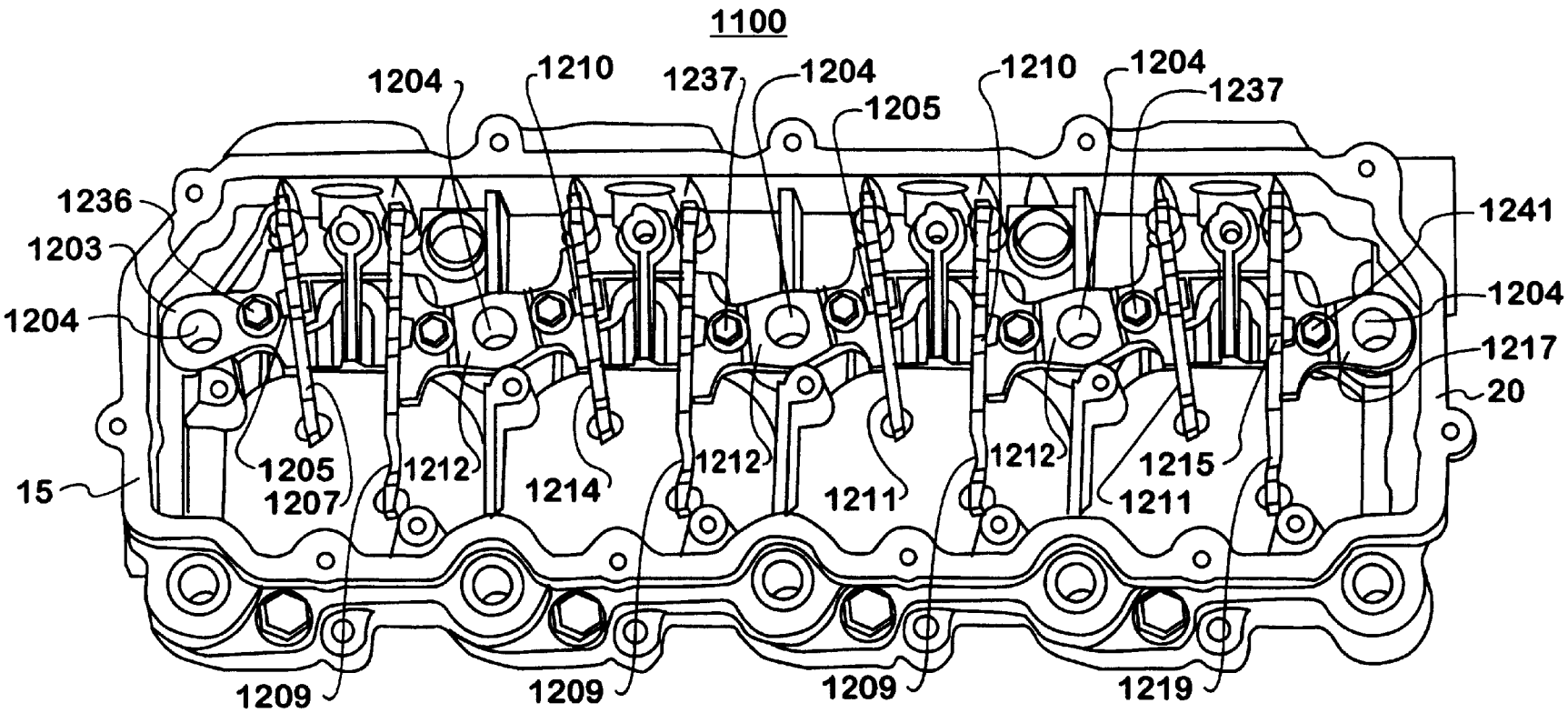
FIG. 12 shows a top perspective view of the second embodiment of the rocker carrier shown in FIG. 11 with rocker arm assemblies mounted thereon.

The dual rocker pedestals 30 are preferably configured to have a pair of opposing hold down bolt bosses 31 such that that the dual fulcrum plate 1212 of the dual rocker arm assembly 1210 can be attached to the rocker carrier 100 by a hold down bolt 1237 (shown in FIG. 12). The first end rocker pedestal 35 is preferably configured to have a hold down bolt boss 36 opposite the first end wall 15 such that that the first end fulcrum plate 1203 of the first single rocker arm assembly 1205 can be attached to the rocker carrier 100 by a hold down bolt 1236 (shown in FIG. 12). In a similar fashion, the second end rocker pedestal 40 is preferably configured to have a hold down bolt boss 41 opposite the second end wall 20 such that the second end fulcrum plate 1217 of the second single rocker arm assembly 1215 can be attached to the rocker carrier 100 by a hold down bolt 1241 (shown in FIG. 12).

Moreover, in the preferred embodiment shown in FIGS. 1 and 2, the rocker arm pedestals 30, 35 and 40 are preferably configured to have interior head bolt passages 37. The interior head bolt passages 37 will further comprise a compression limiter 38 (shown in FIG. 2) which will be press fit into the interior head bolt passage 37. The compression limiters 38 are flush with the rocker arm pedestals 30, 35 and 40. The fulcrum plates, which sit on the rocker arm pedestals 30, 35, and 40 and will be situated as before, will be configured to have a fulcrum passage 1204 (shown in FIG. 12) that coincides with the interior head bolt passages 37. The interior head bolt passages 37 will go all the way through the rocker carrier 100 and will coincide with a passage (not shown) in the cylinder head to a hold down bolt boss in the crank case (not shown).

The interior head bolts passages 37 are important since they allow appropriate long head bolts 1337 (shown in FIG. 13), similar to an M-14 bolt, to be inserted into the fulcrum passages 1204 and the interior head bolt passages 37. The long head bolts 1337 will be fastened to the crack case to provide the clamp load on the head gasket (not shown). The head gasket should provide a good joint between the cylinder head and the crank case and is critical between the cylinder head and crank case. The long head bolts 1337 (shown in FIG. 13) provide more stretch for gasket settling and other forms of permeate joint compression. The viability of the head gasketjoint will be preferably controlled by the clamp load exerted on the head gasket joint through the interior cylinder head bolts 1337 in the interior head bolt passages 37 and exterior head bolt passages 85 (discussed below). Further, compression limiters 38 are preferably steel to prevent the head bolts 1337 from crushing the aluminum rocker carrier 100. In addition, the headbolt 1337 length and counterbore depth in the crankcase is preferably kept the same for all headbolts 1337. This produces a more uniform joint compression and influence on the cylinder bore distortion, thus producing an acceptable head to crankcase joint.

In an alternate embodiment, the end fulcrum plates 1203 and 1217 and the end rocker arm pedestals 35 and 40, and the dual fulcrum plates 1212 and the dual rocker arm pedestals 35 are integrally cast as part of the rocker carrier 100. This alternate integrated rocker carrier casting 100 would be cast such as to provide appropriate structure for proper valve train stiffness. Further, the alternate rocker carrier would omit the hold down bolts 1236, since the fulcrum plates 1203, 1207, 1212 are now cast as part of rocker arm pedestals 30, 35 and 40.

FIGS. 1 and 2 show a plurality of high pressure oil reservoir bosses 45 and 50 where a high pressure reservoir or rail 1305 (shown in FIG. 13) will be mounted. Such as high pressure oil rail or reservoir 1305 would be used in an engine that uses hydraulically activated electronically controlled unit injection (HEUI) fuel systems, or hydraulic fuel systems, that requires high-pressure oil to actuate fuel injectors (not shown). In such a system, the HEUI system typically employs high pressure oil, via the high pressure oil reservoirs 1305, to act on an intensifier piston (not shown) in each fuel injector to drive down a fuel plunger and thereby eject fuel into a combustion chamber.

In this embodiment, the high pressure (HP) oil reservoir bosses 45 and 50 are preferably arranged in two sets 45 and 50. A first set of HP oil reservoir bosses 45 comprises three bosses 45 that are preferably integrally cast adjacent to the dual rocker arm pedestals 30 and to the first end pedestal 35 as part of the rocker carrier 100. The second set of HP oil reservoir bosses 50 are preferably integrally cast adjacent to the front wall 5 on the interior as part of the rocker carrier 100. The high pressure oil reservoir or rail 1305 will be appropriately bolted down on these bosses 45 and 50, as shown in FIG. 13.

FIGS. 1 and 2 further show a plurality of exterior head bolt passages 85 integrally cast with the front wall 5 of the rocker carrier 100. The exterior head bolt passages 85 will also have a exterior compression limiter 86 which is also press fit into the interior head bolt passage 85 and flush with the top 87 of the head bolt passages 85. The exterior compression limiters 86 are preferably steel to prevent a head bolt (not shown) from crushing the aluminum rocker carrier 100. Again, appropriate head bolts, similar to an M-14 bolts, will be inserted in to the exterior head bolt passages 85 and will be bolted to the crack case to provide the clamp load to the head gasket (not shown). Further, in this embodiment the exterior head bolt passages 85 and the exterior compression limiters 86 are longer than the interior head bolt passages 37 and the interior compression limiters 38. This is due to the positioning of the fulcrum plates 1203, 1212 and 1217 (shown in FIG. 12) on top of the interior head bolt passages 37. The fulcrum plates have a thickness of about 10 mm, and that is the difference between the interior and exterior head bolt passages 37 and 85 and compression limiters 38 and 85.

FIGS. 1 and 2 further show a plurality of glow plug passages 80 cast with the front wall 5 of the rocker carrier 100. The glow plug passages 80 are preferably inclined so that the glow plugs (not shown) when installed will be physically positioned to cooperate with a corresponding combustion chamber (not shown). There are also shown top inclined faces 81 corresponding to the inclined glow plug passages 80.

Figure 13:
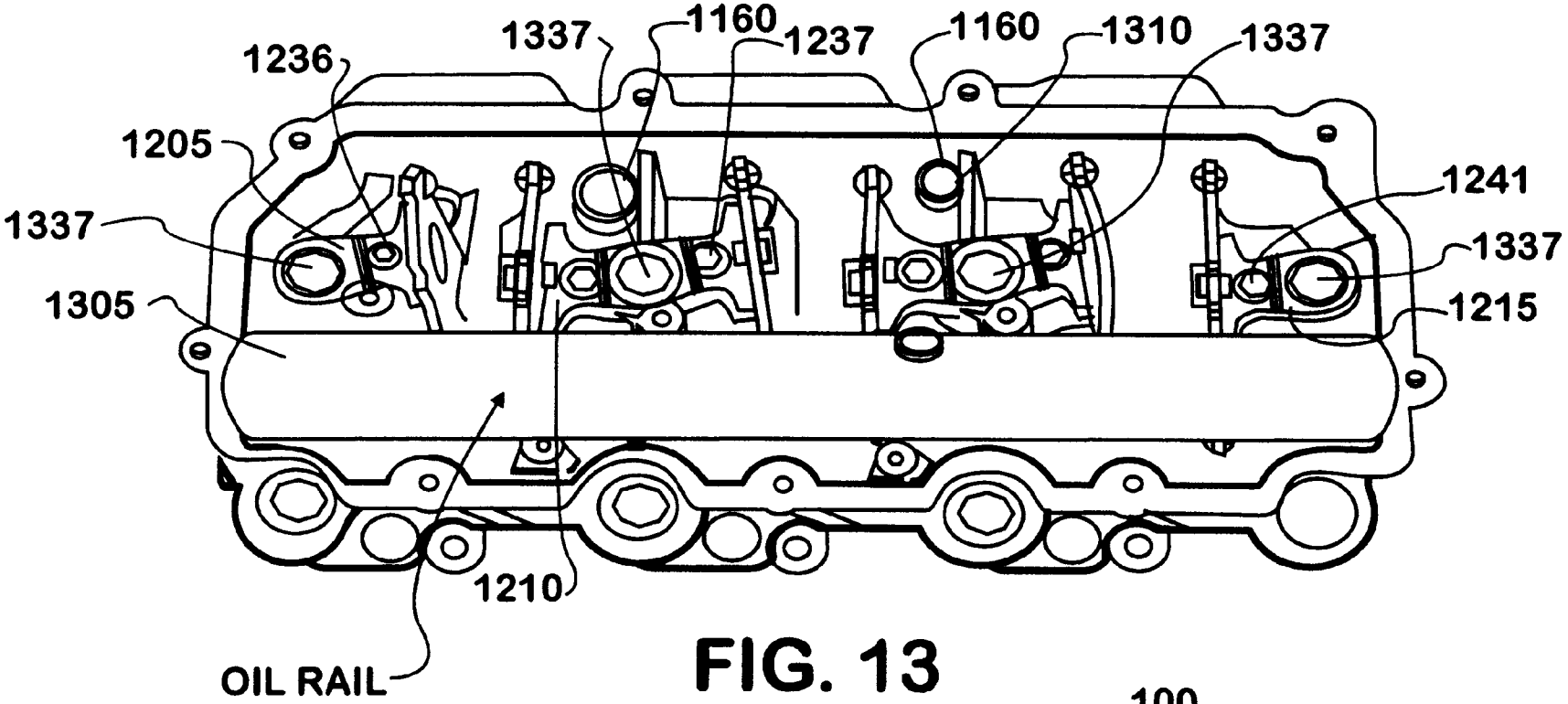
FIG. 13 shows a top perspective view of the first embodiment of the rocker carrier shown in FIG. 2 with a high pressure oil reservoir mounted thereon.

FIGS. 1 and 2 show a plurality of rocker carrier bolt bosses 70 and 75 which will allow the rocker carrier 100 to be bolted down to the top of the cylinder head (shown in FIG. 13). In this embodiment, the rocker carrier bolt bosses 70 and 75 are preferably arranged in two sets 70 and 75. A first set of rocker carrier bolt bosses 70 comprise three carrier bosses 45 that are integrally cast adjacent to the fear wall 10 of the rocker carrier 100, preferably to the interior of the rear wall 10. However those of skill in the art will recognize that other placement of the rocker carrier bolt bosses is possible, e.g., to the exterior of the rear wall 10. The second set of rocker carrier bolt bosses 75 are integrally cast adjacent to the front wall 5 on the exterior of the rocker carrier 100, and adjacent to the glow plug passages 80. The rocker carrier 100 will be appropriately bolted down to the cylinder head via the rocker carrier bolt bosses 70 and 75, as shown in FIG. 13.

FIGS. 1 and 2 show a plurality of push rod passages 55 and 56 which will allow push rods (not shown) to be inserted therein. The push rod passages 55 and 56 are integrally cast adjacent to the rear wall 10 of the rocker carrier 100, preferably to the interior of the rear wall 10. In this embodiment, the push rod passages 55 are preferably situated in pairs 55 and 56 such that each push, rod pair can have one intake and one exhaust push rod (not shown). The intake push rod in the push rod passage pair 55 and 56 will actuate an intake rocker arm 1207 and 1211 (shown in FIG. 12) which will in turn actuate intake valves (not shown) via an intake valve bridge (not shown). The exhaust push rod in the push rod passage pair 55 and 56 will actuate a corresponding exhaust rocker arm 1209 and 1219 (shown in FIG. 12) which will in turn actuate exhaust valves (not shown) via an exhaust valve bridge (not shown). In the embodiment shown in FIGS. 1 and 2, there are three pairs of push rod passages 55 and 56 since the embodiment represent a rocker carrier that would be mounted on one cylinder head of a V-6 type engine. Those of skill in the art will readily recognize that the rocker carrier design can be easily expanded when there is a different number of cylinders, e.g., the V-8 configuration shown in FIGS. 11 and 12.

FIGS. 1 and 2 preferably show two high pressure (HP) oil line passages 60 which facilitate routing of an internal HP oil line 1310 (show in FIG. 13) to the HP oil reservoir 1305 as would be used in an engine with HEUI type fuel system that requires high pressure oil to operate fuel injectors (not shown). The high pressure oil line passages 60 are integrally cast adjacent to the rear wall 10 of the rocker carrier 100, and preferably to the interior of the rear wall 10. The two high pressure oil line passages 60 shown allow the rocker carrier 100 to be mounted on either side of an engine. This is the case since the rocker carrier 100 preferably has a symmetrical design such that it can be used both on the left and right bank of an engine with a V-type configuration. The carrier could also be formed with only one high pressure line passage 60, however, it 100 might then be limited to mounting on one side of an engine.

FIGS. 1 and 2 also show a plurality of structural support members, fins or ribs 6, 7 and 8 that will give the rocker carrier body 100 and the front and rear walls 5 and 10 added strength and help prevent wall vibration. The structural support members or fins 6, 7 and 8 are integrally cast in various preferred locations in the of the rocker carrier 100. A first set of support fins 8 preferably connect the rear wall 10 and the dual rocker arm pedestals 30. The fist set of support fins 8 is further attached to the rocker carrier bottom support floor 9 for added support. A second set of support fins 6 preferably connect the front wall 5 and the first set of central high pressure oil reservoir bosses 45 and 50 that are adjacent to dual rocker arm pedestals 30. There is also a third set of support fins 7 that are preferably attached to the rear set of carrier bosses 70 and the bottom support floor 9. Those of skill in the art will recognize that more or less support fins can be used with rocker carrier 100.

FIG. 1 further shows a plurality of electrical connector passages 65 and an oil drain passage 67 that are preferably integrally cast with the rear wall 10 of the rocker carrier 100. The electrical connector passages 65 will allow wiring to be routed to and from appropriate locations on a fuel injector. There are shown three electrical connector passages 65 since the rocker carrier of this embodiment is intended to be used on one side or bank of a V-6 type engine. The number of electrical connector passages 65 will vary according to the type of engine being used and the number of cylinders in the engine. In this embodiment, there is shown an oil drain passage 65 that will preferably accept drain oil from a turbocharger (not shown). Those of skill in the art will recognize that the oil drain passage 67 could be situated elsewhere on the rocker carrier 100 or somewhere other than the rocker carrier 100. FIG. 1 further shows a top corner section 21 on the rocker carrier 100 that can be used to support auxiliary engine components (not shown) via tapped passages 22. Finally, FIGS. 1 and 2 show a plurality of valve cover bosses 27 formed around the periphery of the top surface 25 of the rocker carrier 100. The valve cover bosses 27 will allow for the connection to the rocker carrier 100 to a typical valve cover (not shown).

Figure 3:
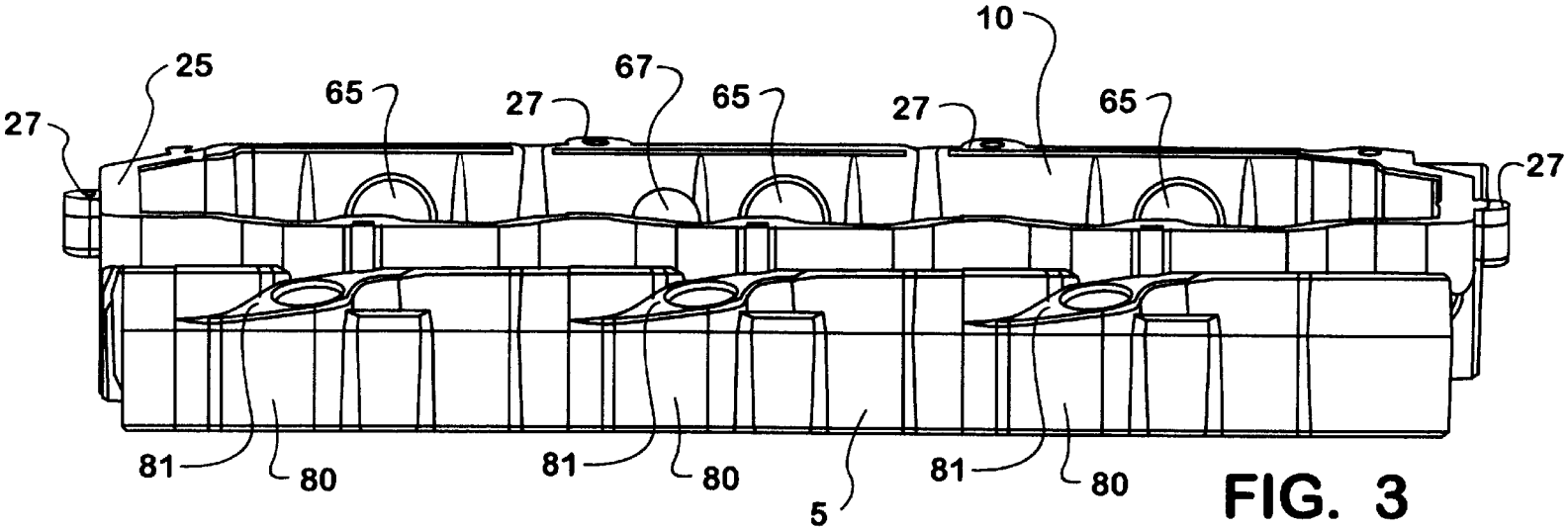
FIG. 3 shows a front view of the rocker carrier shown in FIG. 2.

FIG. 3 shows a front view of the rocker carrier 100 shown in FIGS. 1 and 2. FIG. 3 shows that the top surface 25 of the rocker carrier 100 is preferably inclined. This feature of the rocker carrier 100 allows the rocker carrier to fit well into the limited space available in an engine compartment. There are also shown valve cover bosses 27 along the periphery of the top surface 25. FIG. 3 partially shows the electrical connector passages 65 and the oil drain passage in the rear wall 10 of the rocker-carrier 100. Last, FIG. 3 shows the inclined nature of the top faces 81 of the glow plug passages 80 in the front wall 5 of the rocker carrier 100.

Figure 4:
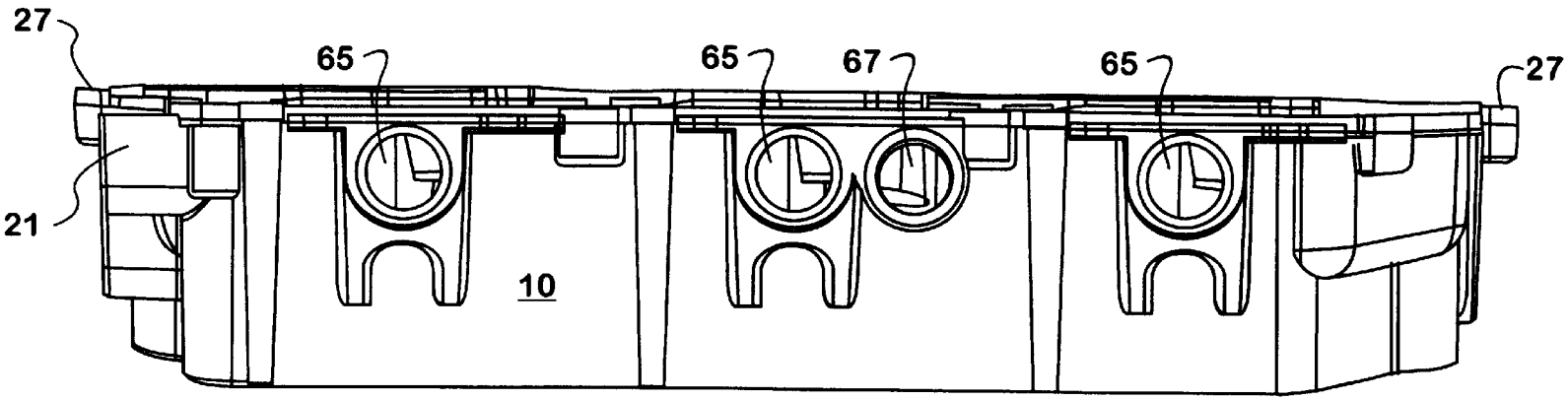
FIG. 4 shows a rear view of the rocker carrier shown in FIG. 2.

FIG. 4 shows a rear view of the rocker carrier 100 shown in FIGS. 1 and 2. FIG. 4 shows the rear wall 10 of the rocker carrier 100. FIG. 4 shows the electrical connector passages 65 and the oil drain passage which are preferably part of the rear wall 10 of the rocker carrier 100 in this embodiment. Also, FIG. 4 shows the top corner section 21 of the rocker carrier 100 that can be used to support auxiliary engine components via tapped passages 22 (shown in FIG. 1).

Figure 5:
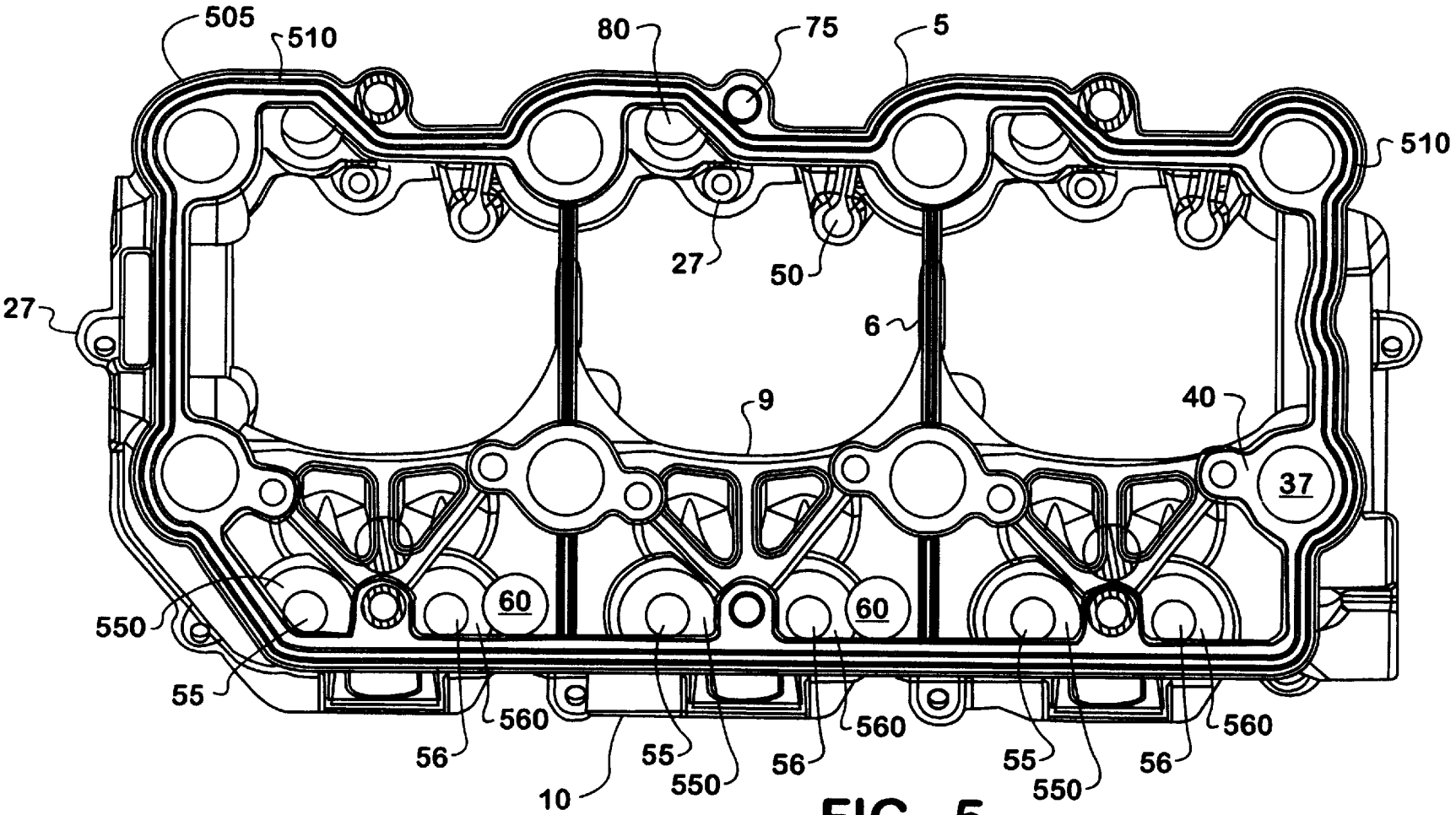
FIG. 5 shows a bottom view of the rocker carrier shown in FIG. 2.

FIG. 5 shows a bottom view of the rocker carrier 100 shown in FIGS. 1 and 2. FIG. 5 is instructive because it shows, in a 2 dimensional view, the respective funnel configuration 550 and 560 of the underside of the push rod passages 55 and 56. The preferred funnel configuration 550 and 560 on the underside of the push rod passages 55 and 56 should make installation of the push rods (not shown) easier. FIG. 5 also shows a bottom surface 505 around the periphery of the rocker carrier 100. In a preferred embodiment, the bottom surface 505 is configured to have a sealing grove 510 around the periphery of the rocker carrier 100. The sealing groove 510 will preferably accept a form gasket to assist in sealing the bottom 505 of the rocker carrier 100 to the top of a cylinder head (not shown). FIG. 5 also shown a bottom view of the various configurations comprising the rocker carrier previously described in with respect to FIGS. 1 and 2.

Figure 6:
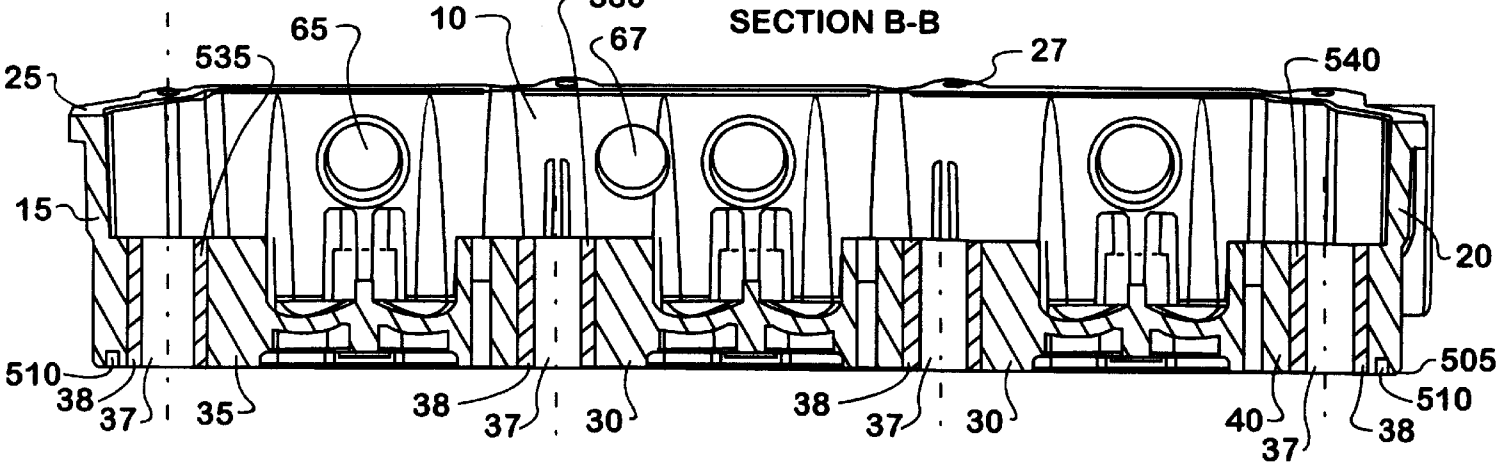
FIG. 6 shows a cross-sectional view along a section line B—B of the rocker carrier shown in FIG. 2.

FIG. 6 shows a cross-sectional view along a section line B—B of the rocker carrier shown in FIG. 2. FIG. 6 shows a cross section of the rocker arm pedestals 30, 35 and 40 and that the respective interior head bolt passage 37 completely traverse the rocker carrier 100. There is also shown that the interior head bolt passages 37 further comprise a compression limiter 38. FIG. 6 shows that the compression limiters 38 are flush with the tops 530, 535 and 540 of the rocker arm pedestals 30, 35 and 40. FIG. 6 also shows the electrical connector passages 65 and the oil drain passage which are preferably part of the rear wall 10 of the rocker carrier 100 in this embodiment. Also, FIG. 6 shows a cross section view of the sealing grove 510 in the bottom surface 505 of the rocker carrier 100. There is also shown a cross section of the first 15 and second 20 opposing end walls along with valve cover bosses 27 in the top surface 25 of the rocker carrier 100.

Figure 7:
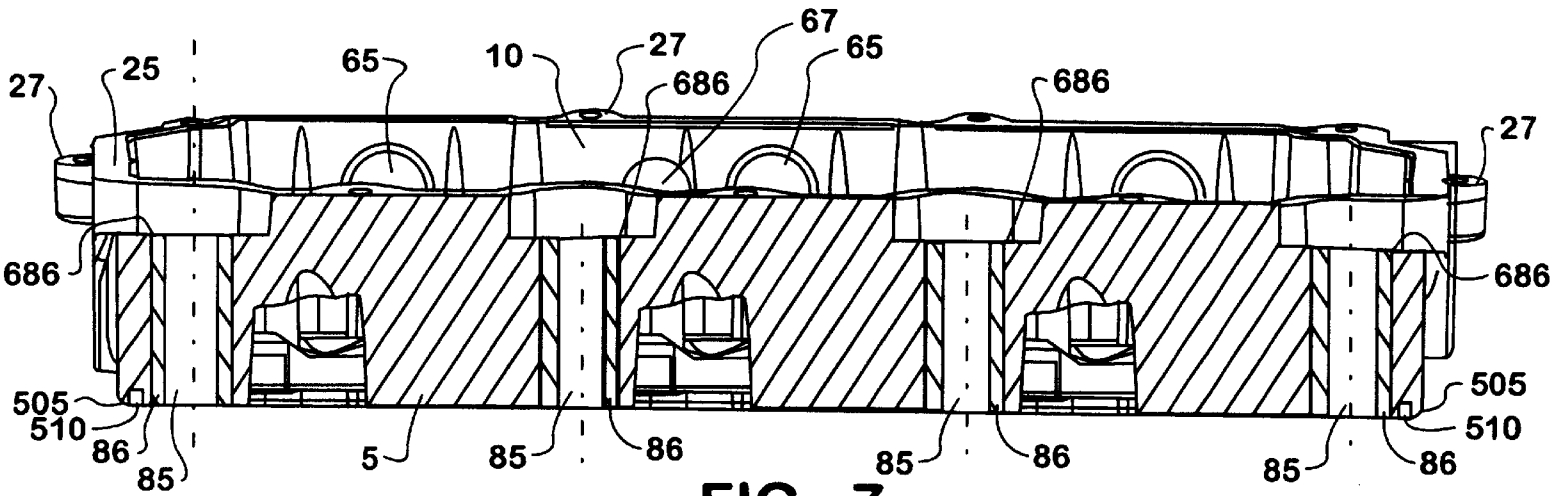
FIG. 7 shows a cross-sectional view along a section line A—A of the rocker carrier shown in FIG. 2.

FIG. 7 shows a cross-sectional view along a section line A—A of the rocker carrier shown in FIG. 2. FIG. 7 shows a cross section of the exterior head bolt passages 85 in the front wall 5 of the rocker carrier 100. There is also shown that the exterior head bolt passages 85 further comprise a compression limiter 86. FIG. 7 shows that the compression limiters 86 are flush with the tops 686 of the exterior head bolt passages 85. FIG. 7 partially shows the electrical connector passages 65 and the oil drain passage that are preferably part of the rear wall 10 of the rocker carrier 100 in this embodiment. Again, FIG. 6 shows a cross section view of the sealing grove 510 in the bottom surface 505 of the rocker carrier 100. There is also shown the valve cover bosses 27 in the top surface 25 of the rocker carrier 100.

Figure 8:
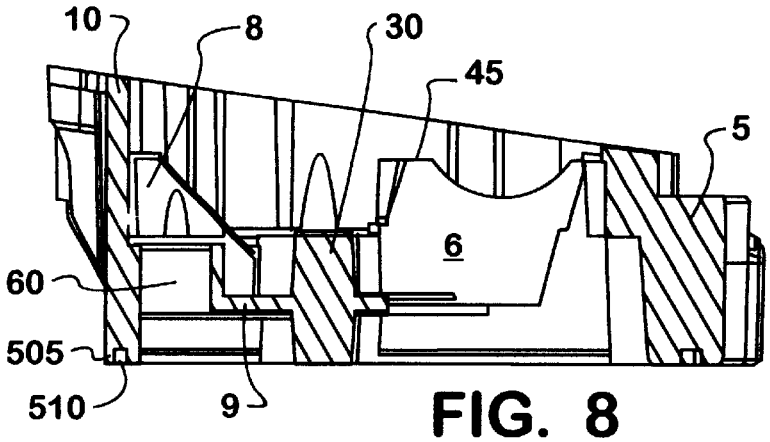
FIG. 8 shows a cross-sectional view along a section line D—D of the rocker carrier shown in FIG. 2.

FIG. 8 shows a cross-sectional view along a section line D—D of the rocker carrier shown in FIG. 2. FIG. 8 shows that the push rod passage 60 is preferably adjacent to the rear wall 100 and completely traverses the rocker carrier 100 support floor 9. FIG. 8 shows a support fin 7 attached to the rear wall 10. There is also shown a support fin 6 between the front wall 5 and a central high pressure oil reservoir boss 45 that is adjacent to a dual rocker arm pedestals 30. Again, FIG. 8 shows a cross section view of the sealing grove 510 in the bottom surface 505 of the rocker carrier 100 (also shown in FIGS. 9 and 10).

Figure 9:
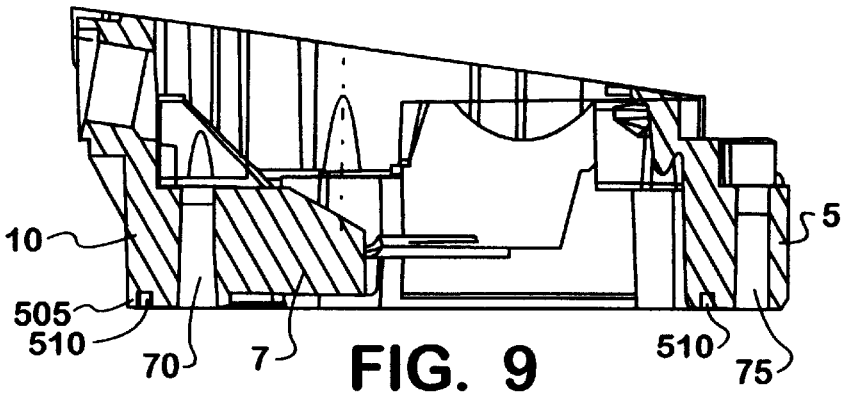
FIG. 9 shows a cross-sectional view along a section line E—E of the rocker carrier shown in FIG. 2.

FIG. 9 shows a cross-sectional view along a section line E—E of the rocker carrier shown in FIG. 2. In particular, FIG. 9 shows a cross section of the interior and exterior rocker carrier bolt bosses 70 and 75 which will allow the rocker carrier 100 to be bolted down to the top of the cylinder head (shown in FIG. 13). The interior or first set of rocker carrier bolt bosses 70 are adjacent to the rear wall 10 and completely traverse the rocker carrier 100. The exterior or second set of rocker carrier bolt bosses 75 are adjacent to the front wall 5 on the exterior of the rocker carrier 100 and completely traverse the rocker carrier 100. FIG. 9 also shows a cross section of a support fin 7 that preferably attach the interior rocker carrier bolt bosses 70 to the bottom support floor 9.

Figure 10:
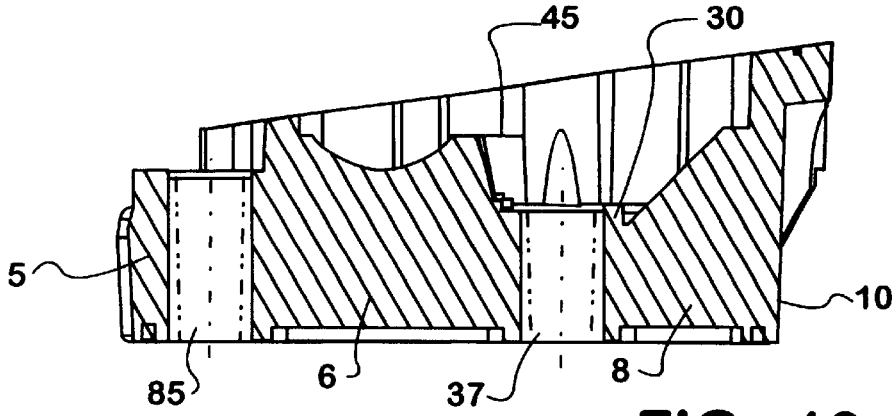
FIG. 10 shows a cross-sectional view along a section line C—C of the rocker carrier shown in FIG. 2.

FIG. 10 shows a cross-sectional view along a section line C—C of the rocker carrier shown in FIG. 2. FIG. 10 shows a cross section of a dual rocker arm pedestals 30 and its respective interior head bolt passage 37 that traverses the rocker carrier 100. FIG. 10 also shows a cross section of an exterior head bolt passages 85 in the front wall 5 of the rocker carrier 100. No compression limiters 38 or 86 are shown in this view for either head bolt passage 37 or 85. There is also shown a support fin 6 between the front wall 5 and a central high pressure oil reservoir boss 45 that is adjacent to a dual rocker arm pedestals 30. Also shown is a support fin 8 connecting the rear wall 10 and the dual rocker arm pedestals 30.

FIG. 11 shows a top view of a second embodiment of the rocker carrier 100 according to the present invention. Those of skill in the art will recognize that the embodiment illustrated by FIGS. 1–10 is a design than can be expanded or adapted to fit various engine applications and types. In this case, FIG. 11 shows a rocker carrier 1100 that is adapted to preferably be used on one side or bank of a V-8 type engine. The rocker carrier 1100 of FIG. 11 is very similar to the rocker carrier of FIGS. 1–10, albeit with longer front 1105 and rear 1110 walls.

Compared to FIGS. 1 and 2, FIG. 11 shows an additional exterior head bolt passage 1185, glow plug passage 1180, exterior carrier boss 1175, and high pressure oil reservoir boss 1150 in the front wall 1105 of the rocker carrier 100. There is an additional dual rocker arm pedestal 1130 with a respective interior head bolt passages 1137 and compression limiter 1138. There is also shown an additional interior carrier boss 1170 between a pair of additional push rod passages 1155 and 1156 adjacent to the rear wall 1110 of the rocker carrier 1110. FIG. 11 further shows additional structural support members or fins 1106, 1107 and 1108 that will give the rocker carrier body 1100 and the front and rear walls 1105 and 1110 added strength and help prevent wall vibration. Last, FIG. 11 shows two additional valve cover bosses 1127 on the top surface 1125.

FIG. 12 shows a top perspective view of the second embodiment of the rocker carrier 1100 shown in FIG. 11 with rocker arm assemblies preferably mounted thereon. FIG. 12 shows a plurality of rocker arm assemblies 1205, 1210 and 1217 mounted on the rocker arm pedestals 30, 1130, 35 and 40 (shown in FIGS. 1, 2 and 11) and attached by hold down bolts 1236, 1237 and 1241. The rocker arm assemblies 1205, 1210 and 1217 have rocker arms 1207, 1209, 1211, 1219 that will actuate valve bridges (not shown) when actuated by push rods (not shown) at appropriate times. FIG. 12 shows that two types of rocker arm assemblies 1205, 1210 and 1217 are preferably used with the rocker carrier 1100, though other appropriate configuration may be used as well.

There are shown three dual rocker arm assemblies 1210 which cooperatively support a dual fulcrum plate 1212. The dual fulcrum plates 1212 will each hold an intake and exhaust rocker arm 1209 and 1211. In a preferred embodiment, the intake and exhaust rocker arms 1209 and 1211 on the dual fulcrum plates 1212 will operate valves on different engine cylinders. During intake, when the dual rocker arm assemblies 1210 operate, the intake rocker arms 1211 will appropriately actuate corresponding intake valves (not shown) via an intake valve bridge (not shown). During exhaust, when the dual rocker arm assemblies 1210 operate, the exhaust rocker arms 1209 will appropriately actuate corresponding exhaust valves (not shown) via an exhaust valve bridge (not shown).

There is also shown a first and second end rocker arm assembly 1205 and 1215 in the rocker carrier 1100 which are adjacent to the first 15 and second 20 end walls which have a first and second end fulcrum plate 1203 and 1217. In the embodiment of FIG. 12, the first end fulcrum plate 1203 will preferably hold an intake rocker arm 1207. During intake, when the first end rocker arm assembly 1205 operates, the intake rocker arm 1207 will appropriately actuate corresponding intake valves (not shown) via an intake valve bridge (not shown). The second end fulcrum plate 1217 will preferably hold an exhaust rocker arm 1219. During exhaust, when second end rocker arm assembly 1215 operates, the exhaust rocker arm 1219 will appropriately actuate corresponding exhaust valves (not shown) via an exhaust valve bridge (not shown).

FIG. 12 further shows that the fulcrum plates 1203, 1212, and 1217 of the rocker arm assemblies 1205, 1210 and 1217 are preferably attached to the rocker carrier 1100 by hold down bolt 1236, 1237 and 1241, e.g. by M-8 type bolts. The bolts 1236, 1237 and 1241 improve the stiffness of the plates 1203, 1212 and 1217 by tying the plates to the rocker carrier 1100. The hold down bolts 1236, 1237 and 1241 also allow the plates to be pre-installed on the rocker carrier 1100 before the head bolts 1337(shown in FIG. 13) are installed. As a result, the rocker carrier 1100 may be pre-assembled with the rocker arm assemblies 1205, 1210 and 1217 installed thus decreasing the assembly plant labor to assemble the engine.

FIG. 13 shows a top perspective view of the first embodiment of the rocker carrier shown in FIGS. 1 and 2 with a high pressure oil reservoir 1305 mounted thereon. There is also shown a high pressure oil line 1310 coming through the rocker carrier 100 via one high pressure oil line passage 1360. Another high pressure line section (not shown) would then complete a connection from the high pressure oil line 1310 in the high pressure passage 1360 and the high pressure oil reservoir 1305. There are also shown rocker arm assemblies 1205, 1210 and 1217 that are preferably attached to the rocker carrier 100 by hold down bolts 1236, 1237 and 1241, and a plurality of interior head bolts 1337.

The rocker carrier 100 enables a modular assembly of the cylinder head with the rocker carrier before installing the cylinder head with the rocker on the crankcase. The modular assembly reduces in-plant assembly costs and assembly time. In one arrangement of the modular assembly, the modular unit includes the cylinder head assembly, head installed valve train parts, fuel injectors, glow plugs, rocker arm carrier, electrical connections, and the oil rail. However, other arrangements including more or less components are possible. The modular assembly may be assembled and tested on a sub-assembly line. The cylinder head with the rocker carrier can then be installed on the crankcase using head bolts 1335 to complete the engine assembly.

The invention has been described and illustrated with respect to certain preferred embodiments by way of example only. Those skilled in that art will recognize that the preferred embodiments may be altered or amended without departing from the true spirit and scope of the invention. Therefore, the invention is not limited to the specific details, representative devices, and illustrated examples in this description. The present invention is limited only by the following claims and equivalents.

I claim:

1. A rocker carrier adapted for use with a cylinder head in an internal combustion engine comprising:

a body portion having a continuous peripheral wall including a front and rear wall connected between a first and second end wall;

a plurality of rocker arm pedestals integrally formed on the body portion and disposed between the rear and front walls;

a top surface able to cooperatively engage a valve cover; and a bottom surface able to cooperatively engage a cylinder head.

2. The rocker carrier of claim 1, wherein the rocker arm pedestals comprise a dual rocker arm pedestal or an end rocker pedestal.

3. The rocker carrier of claim 2, wherein the rocker arm pedestals further comprise an interior head bolt passage.

4. The rocker carrier of claim 1, wherein the rocker arm pedestal is adapted to support a rocker arm assembly.

5. The rocker carrier of claim 4, wherein the rocker arm assembly comprises a single mount fulcrum plate or a dual mount fulcrum plate.

6. The rocker carrier of claim 3, further comprising a plurality of exterior head bolt passages adjacent to the front wall.

7. The rocker carrier of claim 6, wherein the plurality of exterior and interior head bolt passages further comprise a compression limiter.

8. The rocker carrier of claim 2, further comprising a plurality of push rod passages formed adjacent to the rear wall.

9. The rocker carrier of claim 8, wherein the push rod passages are funnel shaped on a bottom surface side.

10. The rocker carrier of claim 2, further comprising a high pressure oil line passage.

11. The rocker carrier of claim 10, wherein the high pressure line oil passage is adjacent to the rear wall.

12. The rocker carrier of claim 2, further comprising a plurality of high pressure oil reservoir bosses.

13. The rocker carrier of claim 12, wherein at least one high pressure oil reservoir boss is adjacent to the rocker arm pedestals, and at least one high pressure oil reservoir boss is adjacent to the front wall.

14. The rocker carrier of claim 12, further comprising a plurality of valve cover bosses formed on the top surface.

15. The rocker carrier of claim 12, further comprising a plurality of carrier bolt bosses.

16. The rocker carrier of claim 15, further comprising a plurality of structural support fins cooperatively connecting the rocker arm pedestals to the front and rear walls.

17. The rocker carrier of claim 12, further comprising a plurality of glow plug passages integrally formed with the front wall.

18. The rocker carrier of claim 17, wherein the glow plug passages have an inclined top face.

19. The rocker carrier of claim 2, further comprising a plurality of electrical connector passages integrally formed with the rear wall.

20. The rocker carrier of claim 19, further comprising a oil drain passage integrally formed with the rear wall.

21. The rocker carrier of claim 15, further comprising a sealing groove around the periphery of the bottom surface.

22. The rocker carrier of claim 1, wherein the rocker carrier is comprised of cast aluminum material.

23. A rocker carrier adapted for use on top of a cylinder head in an internal combustion engine comprising:

a body portion having a thin continuous peripheral wall including a front and rear wall connected between a first and second end wall;

a plurality of rocker arm pedestals integrally formed on the body portion and disposed between the rear and front walls;

a high pressure oil line passage integrally formed adjacent to the rear wall;

a plurality of high pressure oil reservoir bosses integrally formed on the body portion and disposed between the rocker arm pedestals and the front wall;

a top surface able to cooperatively engage a valve cover; and a bottom surface able to cooperatively engage a cylinder head.

24. The rocker carrier of claim 23, wherein the rocker arm pedestals comprise a dual rocker arm pedestal or an end rocker pedestal.

25. The rocker carrier of claim 24, wherein the front wall further comprises a plurality of exterior head bolt passages;

a plurality of carrier bolt bosses; and a plurality of glow plug passages.

26. The rocker carrier of claim 24, wherein the rear wall further comprises a plurality of electrical connector passages;

an oil drain passage; and a plurality of valve cover bosses.

* * * * *